United States Patent [19]

Gardner et al.

[11] 4,280,650

[45] Jul. 28, 1981

[54] PARTITION STRUCTURE

[75] Inventors: Jeffrey M. Gardner, Wheaton; Ronald R. Sensenbrenner, St. Charles; Bennie C. Nelson, Jr., Romeoville, all of Ill.

[73] Assignee: Container Corporation of America, Chicago, Ill.

[21] Appl. No.: 93,044

[22] Filed: Nov. 13, 1979

[51] Int. Cl.[3] ..... B65D 5/20; B65D 5/42; B65D 5/48

[52] U.S. Cl. ..... 229/15; 229/28 R

[58] Field of Search ..... 229/15, 42, 28 R

[56] References Cited

U.S. PATENT DOCUMENTS

| | | | |
|---|---|---|---|
| 3,738,561 | 6/1973 | Nederveld | 229/15 |
| 3,834,608 | 9/1974 | Giebel | 229/15 |
| 3,921,891 | 11/1975 | Gorham | 229/15 |
| 4,030,659 | 6/1977 | Gardner | 229/15 |
| 4,136,815 | 1/1979 | Gardner | 229/15 |
| 4,148,428 | 4/1979 | Gardner | 229/15 |
| 4,155,501 | 5/1979 | Young | 229/15 |

*Primary Examiner*—Davis T. Moorhead

*Attorney, Agent, or Firm*—R. W. Carpenter; Davis Chin

[57] ABSTRACT

A partition structure for forming compartments for separation and support of individual articles is formed from a blank to provide a pair of laterally spaced vertical partition elements foldably connected to vertical panels foldable against the ends thereof, the vertical panels being provided with bottom and inner vertical panel elements foldable into position to define a plurality of compartments.

2 Claims, 3 Drawing Figures

PARTITION STRUCTURE

BACKGROUND OF THE INVENTION

1. Field of the Invention

The structure according to the invention relates to packaging and provides for a number of compartments formed from a single cut and scored blank.

2. The Prior Art

The invention structure herein provides an improvement over that exemplified in Gardner, U.S. Pat. No. 4,030,659 wherein a single cut and scored blank provides a structure of only four compartments.

SUMMARY OF THE INVENTION

By providing laterally spaced, opposed, transversely extending partition elements, it is possible to form a partition structure having six compartments instead of four, all being formed from a single cut and scored blank. This is accomplished by having the transverse elements spaced from each other when they are disposed in the blank.

THE DRAWING

THE SPECIFICATION

Figure 1:
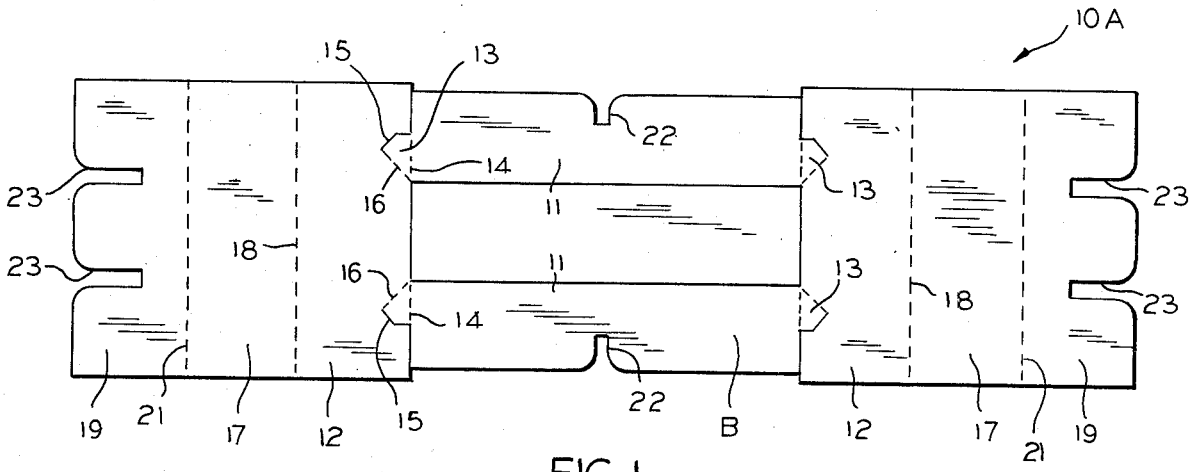
FIG. 1 is a plan view of a cut and scored blank for forming a partition structure according to the present invention.
Figure 2:
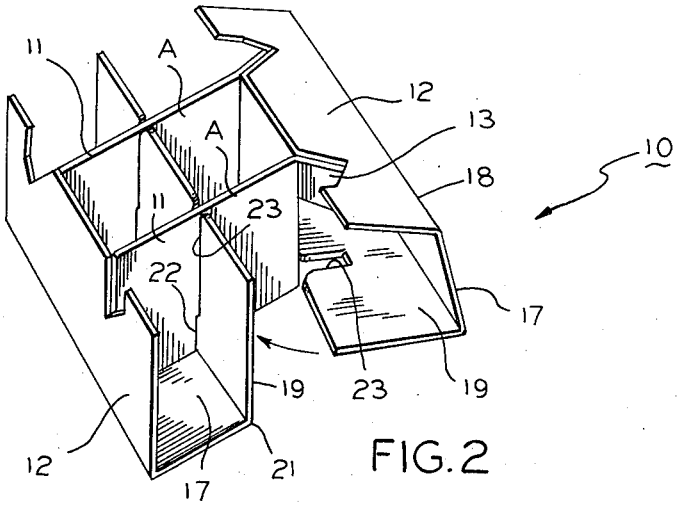
FIG. 2 is an isometric view showing a step of forming the blank of FIG. 1 into an erected form.
Figure 3:
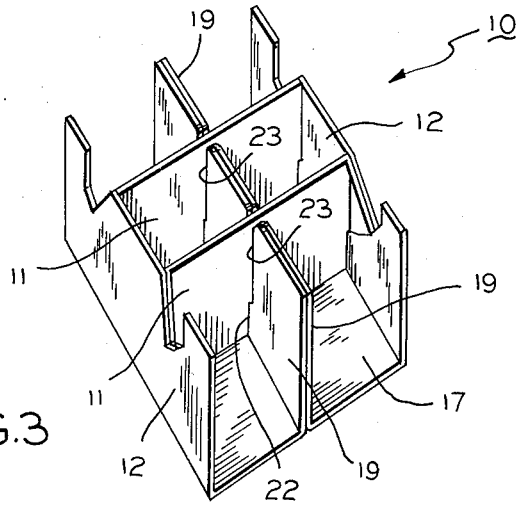
FIG. 3 is an isometric view showing a completely erected partition.

The improved partition structure is referred to generally by the reference numeral 10, and is formed from a cut and scored blank of paperboard 10A.

A pair of laterally spaced opposed transversely extending partition elements 11 are formed in the blank 10A. Each end of the elements 11 is connected by gussets 13 to vertical panels 12. The gussets 13 are defined by fold lines 14, cut lines 15 and inclined fold lines 16, the arrangement being such that when the elements 11 are erected into spaced parallel relationship, the panels 12 will likewise be erected into spaced parallel relationship against the ends of the elements 11.

Each of the panels 12 is foldably joined to a bottom panel 17 along a fold line 18, and each of the bottom panels 17 is joined to an inner vertical panel element 19 along a fold line 21.

The inner vertical panel elements 19 are brought into engagement with transversely extending partition elements 11 by means of slots 22 formed in the elements 11 and cooperating with slots 23 formed in the vertical panel elements 19.

The resultant structure provides six cells or compartments from a single blank of paperboard, or the like.

We claim:

1. A partition structure for forming six compartments for separation and support of individual articles, said structure being formed from a cut and scored blank of paperboard or the like and comprising:

(a) a pair of laterally spaced opposed transversely extending partition elements in the erected position thereof;

(b) a vertical panel connected along inclined fold lines of gusset members to each end of said partition elements and foldable against the ends thereof;

(c) a bottom panel foldable with respect to each said vertical panel and foldable against the bottom of said partition elements when erected:

(d) a pair of inner vertical panel elements, each said inner vertical panel element foldable with respect to each said bottom panel to be engageable with said transversely extending partition elements and disposed in face-to-face relation to form a double-ply central portion to provide a number of compartments defined by said transverse partition elements and said inner vertical panel elements.

2. A partition structure according to claim 1, wherein a central slot is provided in each transverse partition element and a pair of slots is provided in each inner vertical panel element for locking said transverse partition elements to said inner vertical panel elements.

* * * * *